US010543707B2

(12) United States Patent
Zhou et al.

(10) Patent No.: US 10,543,707 B2
(45) Date of Patent: Jan. 28, 2020

(54) RECORDING MEDIA

(75) Inventors: Xiaoqi Zhou, San Diego, CA (US); David Edmondson, San Diego, CA (US); Rodney D. Stramel, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 704 days.

(21) Appl. No.: 14/113,567

(22) PCT Filed: Apr. 28, 2011

(86) PCT No.: PCT/US2011/034400
§ 371 (c)(1),
(2), (4) Date: Oct. 23, 2013

(87) PCT Pub. No.: WO2012/148404
PCT Pub. Date: Nov. 1, 2012

(65) Prior Publication Data
US 2014/0044897 A1 Feb. 13, 2014

(51) Int. Cl.
*B41M 5/00* (2006.01)
*B41M 5/52* (2006.01)
*B41M 5/50* (2006.01)

(52) U.S. Cl.
CPC ..... *B41M 5/52* (2013.01); *B41M 5/506* (2013.01); *B41M 5/5254* (2013.01); *Y10T 428/24802* (2015.01)

(58) Field of Classification Search
None
See application file for complete search history.

(56) References Cited

U.S. PATENT DOCUMENTS 4,328,284 A * 5/1982 LePoutre ..... B41M 5/5254 427/382
4,489,188 A 12/1984 Jones et al.
5,236,987 A 8/1993 Arendt
(Continued)

FOREIGN PATENT DOCUMENTS

CN 1352599 A 6/2002
CN 101365760 A 2/2009
(Continued)

OTHER PUBLICATIONS

BASF, Acronal S 782 na, Feb. 2015, p. 1, retrieved from https://worldaccount.basf.com/wa/NAFTA~en_US/Catalog/Additives/doc4/BASF/PRD/30193826/.pdf?asset_type=pi/pdf&language=EN&urn=urn:documentum:eCommerce_sol_EU:09007bb280178723.pdf (Year: 2015).*
(Continued)

*Primary Examiner* — Elizabeth A Robinson
*Assistant Examiner* — Daniel D Lowrey
(74) *Attorney, Agent, or Firm* — Dierker & Kavanaughh PC

(57) ABSTRACT

A recording media containing a raw base substrate having, on its image side, a primary coating layer and a top image receiving layer is described herein. Said top image receiving layer encompasses a polymeric adhesion promoter having a glass transition temperature that is at, or above, 90° C. Also described is a printed article containing said recording media on which a printed feature has been formed with an ink composition that encompasses latex components that have a glass transition temperature that is at, or above, 90° C.

16 Claims, 2 Drawing Sheets

(56) References Cited

U.S. PATENT DOCUMENTS

| | | | | |
|---|---|---|---|---|
| 5,308,680 | A * | 5/1994 | Desjarlais | B41M 5/52 428/206 |
| 6,248,432 | B1 | 6/2001 | Moronuki et al. | |
| 6,372,329 | B1 | 4/2002 | Graczyk et al. | |
| 6,447,883 | B1 | 9/2002 | Chen et al. | |
| 6,506,479 | B1 * | 1/2003 | Horiuchi | B41M 5/506 428/195.1 |
| 7,696,262 | B2 | 4/2010 | Cagle et al. | |
| 7,754,296 | B2 | 7/2010 | Khoultchaev et al. | |
| 7,811,656 | B2 | 10/2010 | Grandhee et al. | |
| 2004/0115557 | A1 * | 6/2004 | Bourdelais | B41M 5/506 430/201 |
| 2005/0191445 | A1 * | 9/2005 | Sen | B41M 5/52 428/32.34 |
| 2007/0218254 | A1 | 9/2007 | Zhou et al. | |
| 2007/0242124 | A1 * | 10/2007 | Tomita | B41M 5/5254 347/105 |
| 2008/0057230 | A1 * | 3/2008 | Read | B41M 5/5254 428/32.6 |
| 2008/0081134 | A1 * | 4/2008 | Irita | B41M 5/44 428/32.76 |
| 2008/0233352 | A1 | 9/2008 | Smith et al. | |
| 2010/0243141 | A1 | 9/2010 | Muro et al. | |
| 2013/0201251 | A1 * | 8/2013 | Pal | B41M 5/502 347/20 |

FOREIGN PATENT DOCUMENTS

| | | | |
|---|---|---|---|
| CN | 101668629 | A | 3/2010 |
| EP | 1232873 | A1 | 8/2002 |
| EP | 2050784 | A1 | 4/2009 |
| JP | 2000007961 | | 1/2000 |
| JP | 2005048014 | | 2/2005 |
| JP | 2005062845 | | 3/2005 |
| JP | 2006103194 | | 4/2006 |
| JP | 2006110986 | | 4/2006 |
| JP | 2006240257 | | 9/2006 |
| JP | 2007290339 | | 11/2007 |
| JP | 2008207409 | | 9/2008 |
| JP | 2008246946 | | 10/2008 |
| JP | 2009113292 | | 5/2009 |
| JP | 2010094850 | | 4/2010 |
| JP | 2010162759 | | 7/2010 |
| JP | 2011042150 | | 3/2011 |
| WO | 03078513 | A1 | 9/2003 |
| WO | 2007095136 | A1 | 8/2007 |

OTHER PUBLICATIONS

Petri et al, High performance Acrylic Dispersions for Masonry and Wood Coatings, Nov. 5, 2015, Celanese, p. 8, retrieved from http://www.asefapi.es/congreso3/Preview/files/CELANESE.pdf (Year: 2015).*

Office Action with Search Report (CNOA/SR) (10 pages) from State Intellectual Property Office (SIPO) of People's Republic of China (PRC) dated Jun. 26, 2014 and English translation of Search Report portion (2 pages) (12 pages total) for foreign counterpart China (CN) patent application No. 201180070457.4.

Extended European Search Report (EESR) from the European Patent Office dated May 19, 2014 (6 pages) for foreign counterpart EP patent application No. 11864275.

International Search Report (ISR) and Written Opinion of the International Searching Authority ISA/KR) for counterpart PCT Application No. PCT/US2011/034400, dated Jan. 18, 2012, 9 pages.

* cited by examiner

RECORDING MEDIA

BACKGROUND OF THE INVENTION

Inkjet printing technology is a non-impact printing method in which an electronic signal controls and directs droplets or a stream of ink that can be deposited on a wide variety of substrates. Inkjet technology is, nowadays, becoming a popular way of recording images on various media surfaces. Inkjet printers have thus found broad applications across markets, ranging from industrial labeling to short run printing, to desktop document, pictorial imaging and large format printing for outdoor applications such as banners, displays, posters, billboard and vehicle wraps.

It becomes apparent that the image quality and durability of printed images, obtained using such printing technology, are strongly dependent of the construction of the print media, of the ink composition used and of their interaction. Most of the inkjet ink compositions are water-based, their colorant constituents are thus often water-soluble or water dispersible. Therefore, because of their water-based nature, such inkjet inks tend to exhibit poor image durability when exposed to water or high humidity Inkjet ink composition containing latexes have been developed in view of improving the durability of such inks Said inks contains submicron polymeric latex particles of high molecular weight that are dispersed in an aqueous fluid. Both dyes and pigments have been used as colorants for such inkjet ink formulations. However, when the ink formulations contain latex, such materials do not always adhere well to the substrates to which the ink is applied. The resulting printed image might have durability issues such as abrasion resistance, lightfastness, solvent-fastness and water-fastness. In inkjet printing method, the receiving media substrates play a key role in the overall image quality and permanence of the printed images. Accordingly, it has often created challenges to find media which can be effectively used with such printing techniques and which have good image quality and good adhesion capability.

BRIEF DESCRIPTION OF THE DRAWINGS

The drawings illustrate various embodiments of the present system and method and are part of the specification. FIG. 3, FIG. 4 and FIG. 5 are cross-sectional views of a printed article according to embodiments of the present disclosure.

DETAILED DESCRIPTION

Figure 1:
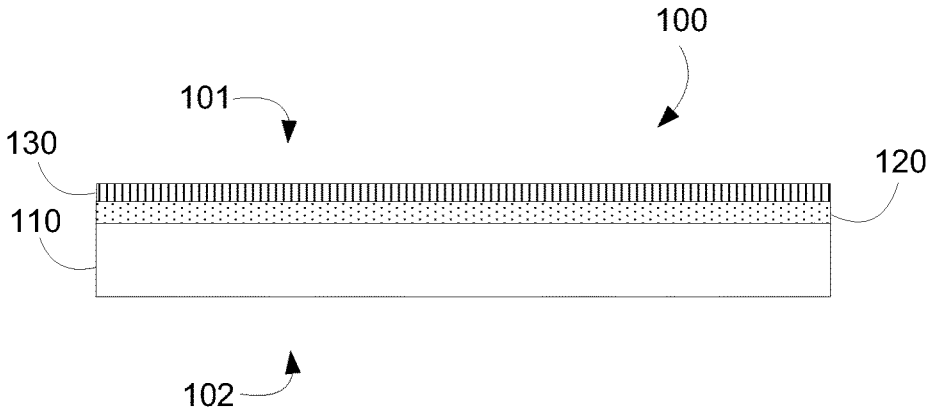
FIG. 1, FIG. 2 and FIG. 3 are cross-sectional views of a recording media according to embodiments of the present disclosure.

Embodiments of the present disclosure will employ, unless otherwise indicated, techniques of synthetic organic chemistry, ink chemistry, media chemistry, printing chemistry, and the like, that are within the skill of the art. Such techniques are explained fully in the literature. The examples are put forth to provide those of ordinary skill in the art with a complete disclosure and description of how to perform the methods and use the compositions disclosed herein. Efforts have been made to ensure accuracy with respect to numbers (e.g., amounts, temperature, etc.) but some errors and deviations should be accounted for. Unless indicated otherwise, parts are parts by weight, temperature is in ° C., and pressure is at or near atmospheric. Standard temperature and pressure are defined as 20° C. and 1 atmosphere. Unless otherwise indicated, the viscosity is expressed in cP and is measured at a temperature of 25° C. Before the embodiments of the present disclosure are described in detail, it is to be understood that, unless otherwise indicated, the present disclosure is not limited to particular materials, and processes disclosed herein as such may vary to some degree. It is also to be understood that the terminology used herein is for purposes of describing particular embodiments only, and is not intended to be limiting, as the scope of the present invention will be defined only by the claims and equivalents thereof. In the present specification, and in the claims, the following terminology will be used: the singular forms "a", "an", and "the" include plural referents unless the context clearly dictates otherwise. Thus, for example, reference to "a support" includes a plurality of supports. The terms "about" and "approximately," when referring to a numerical value or range is intended to encompass the values resulting from experimental error that can occur when taking measurements. Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight range of approximately 1 wt % to approximately 20 wt % should be interpreted to include not only the explicitly recited concentration limits of 1 wt % to approximately 20 wt %, but also to include individual concentrations such as 2 wt %, 3 wt %, 4 wt %, and sub-ranges such as 5 wt % to 15 wt %, 10 wt % to 20 wt %, etc. As used herein, "images" refers to marks, signs, symbols, figures, indications, and/or appearances deposited upon a material or substrate with either visible or an invisible ink composition. Examples of an image can include characters, words, numbers, alphanumeric symbols, punctuation, text, lines, underlines, highlights, and the like.

In some embodiments, the present disclosure provides recording media containing a raw base substrate having, on its image side, a primary coating layer and a top image-receiving layer wherein said image receiving layer encompasses a polymeric adhesion promoter having a glass transition temperature (Tg) that is at, or higher, than 90° C. In some examples, such recording or receptive media is an inkjet printable media well adapted for inkjet printing device. In some other embodiments, the present disclosure refers to a printing method for producing durable images on a recording media. Said method encompasses obtaining an inkjet recording media containing a raw base substrate having, on its image side, a primary coating layer and a top image receiving layer wherein said image receiving layer encompasses a polymeric adhesion promoter having a glass transition temperature (Tg) that is at, or above, 90° C. and jetting an ink composition containing latex onto said recording media to form a printed image with enhanced image quality and enhanced image permanence. In some examples, the method further encompasses a drying step. In some examples, the ink composition used herein contains a latex component that is identical to the polymeric adhesion promoter present in the image receiving layer of the recording media. In yet some other embodiments, the present disclosure refers to a printed article containing the recording media such as defined herein on which a printed feature has been formed with an ink composition. Said recording media is an inkjet printable media with a raw base substrate comprising, on its image side, a primary coat layer and a top image receiving layer wherein said image receiving layer encompasses a polymeric adhesion promoter having a glass transition temperature (Tg) that is at, or above, 90° C. and wherein the ink composition encompasses latex components that have a glass transition temperature (Tg) that is at, or above, 90° C.

The recording media, the printing method and the printed article of the present disclosure have the ability to provide prints with improved printing performances, specifically improved adhesion performances to ink colorant particles. In some examples, the images printed on the recording media, such as described herein, are able to impart excellent image quality. In some other examples, the printed images impart good adhesion capability to ink colorant and latex particles when an ink composition containing latex is used for forming the printed image. The media described herein has the ability to provide excellent image quality: it has good adhesion (helps avoid ink-running issues) and has good ink water and scratch resistance. Furthermore, when used in a printing process using latex ink composition, the resulting printed image presents good wet and dry scrub strength as well as excellent ink adhesion to the surface. Indeed, without being linked by any theory, it is believed that the image durability strongly depends upon the adhesion of ink colorant and latex particles to media surface.

Figure 2:
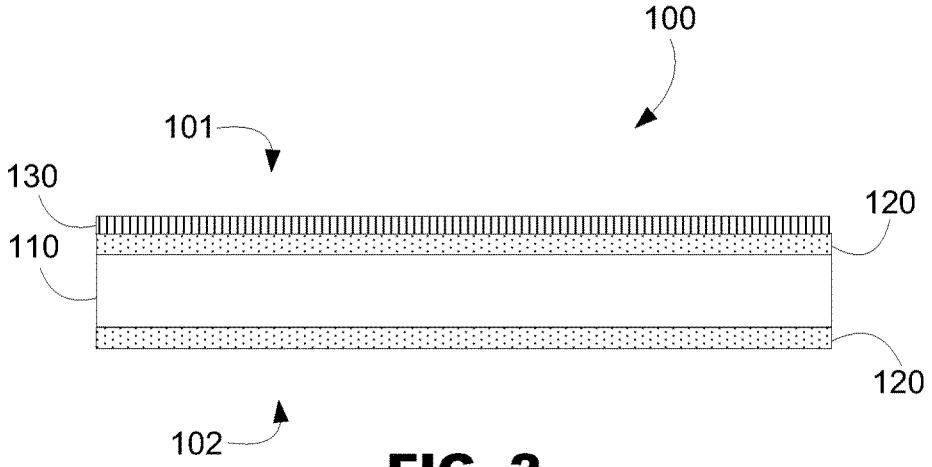
Figure 3:
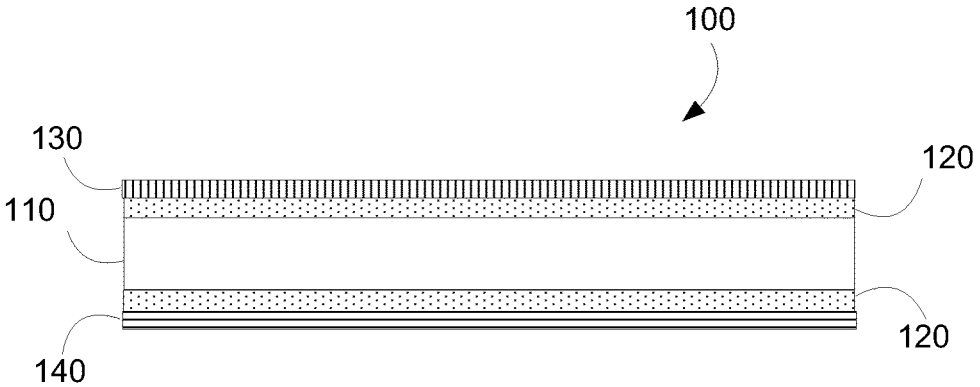

FIG. 1, FIG. 2 and FIG. 3 illustrate some embodiments of the recording media (100). As will be appreciated by those skilled in the art, FIG. 1, FIG. 2 and FIG. 3 illustrate the relative positioning of the various layers of the recording media (100) without necessarily illustrating the relative thicknesses of said layers. As shown in FIG. 1, FIG. 2 and FIG. 3, the recording media (100) encompasses a base substrate (110). The base substrate (110) has two surfaces: a first surface that might be referred to as the "image surface" or "image side" (101), and a second surface, the opposite surface, which might be referred to as the "back surface" or "back side" (102). Thus, the recording media (100) contains an image side (101), i.e. wherein the image is deposited, and a back side (102) which is not very well adapted to receive some image. FIG. 1 illustrates some embodiments of the recording media (100). Such media includes a primary coating layer (120) that is applied on the image side (101) of the base substrate (110). The recording media (100) further includes a top image-receiving layer (130) that is applied over the primary coating layer (120) on the image side (101) of the media. FIG. 2 illustrates some other embodiments of the recording media (100). Such media includes primary coating layers (120) that are applied on both sides of the base substrate (110). The primary coating layers (120) are thus present on the back side (102) and on the image side (101) of the base substrate (110). The recording media (100) further includes a top image-receiving layer (130) that is applied over the primary coating layer (120) on the image side (101) of the media. FIG. 3 illustrates yet some other embodiments of the recording media (100). Such recording media includes primary coating layers (120) that are applied on both sides of the base substrate (110). The primary coating layers (120) are thus present on the back side (102) and on the image side (101) of the base substrate (110). The recording media (100) includes a top image-receiving layer (130) that is applied over the primary coating layer (120) on the image side (101) of the media and includes an adhesive layer (140) that is applied over the primary coating layer (120) on the back side (102) of the media.

Figure 4:
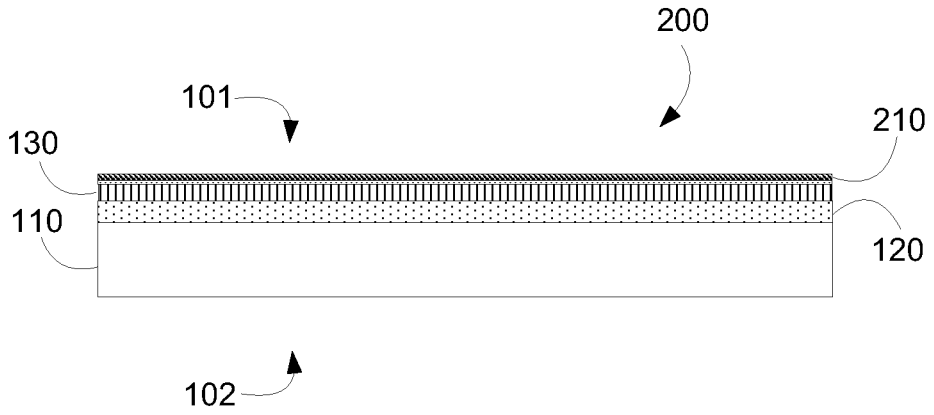
Figure 5:
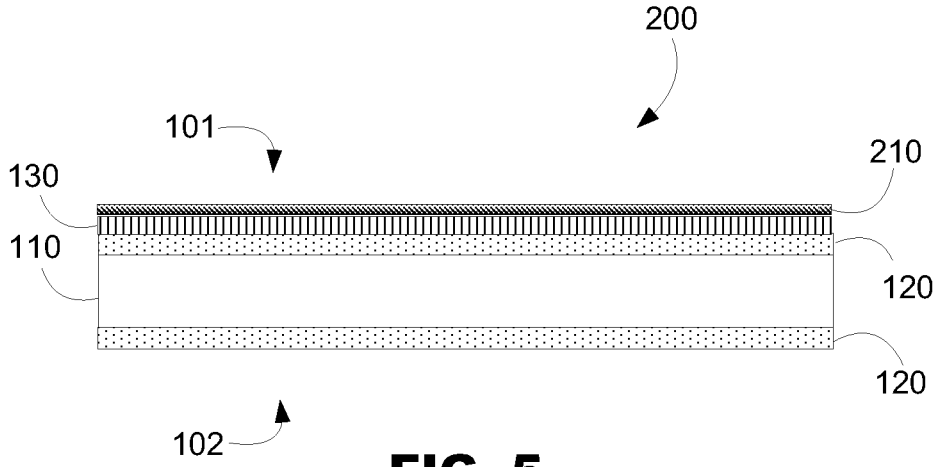
Figure 6:
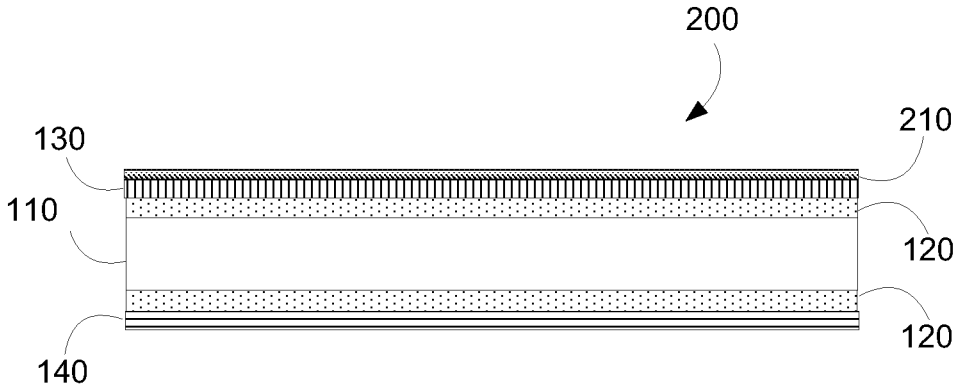

FIG. 4, FIG. 5 and FIG. 6 illustrate some embodiments of the printed article (200). FIG. 4 illustrates some embodiments of the printed article (200) wherein such printed article (200) includes a recording media (100) having a primary coating layer (120), a top image-receiving layer (130) applied on the image side (101) of the base substrate (110), and includes a printed feature (210) that has been formed with an ink composition containing latex components having a glass transition temperature (Tg) that is at, or above, 90° C. FIG. 5 illustrates some other embodiments of the printed article (200), wherein such printed article (200), includes a recording media (100) having primary coating layers (120) that are applied on both sides of the base substrate (110), a top image-receiving layer (130) applied on the image side (101) of the base substrate (110), and includes a printed feature (210) that has been formed with an ink composition containing latex components having a glass transition temperature (Tg) that is at, or above, 90° C. FIG. 6 illustrates yet some other embodiments of the printed article (200), wherein such printed article (200) includes a recording media (100) having primary coating layers (120) on both sides of the base substrate (110), a top image-receiving layer (130) applied on the image side (101) over the primary coating layer (120); an adhesive layer (140) applied over the primary coating layer (120) on the back side (102) of the media and a printed feature (210) that has been formed with an ink composition containing latex components having a glass transition temperature (Tg) that is at, or above, 90° C.

In some embodiments, the recording media (100) contains a raw base substrate (110) having, on its image side, a primary coating layer (120) and a top image-receiving layer (130). In some examples, the raw base substrate (110) is a media substrate that can be a cellulose paper base, a polymeric film base or a non-organic film base. In some examples, the raw base has a base weight of about 50 to about 300 grams/meter$^2$ (gsm), and, in some other examples, the raw has a base weight of about 100 to about 220 gsm. In some embodiments, the raw base (110) is a cellulose base paper. Any kind of cellulose raw base may be used. The raw base (110) can be made of any suitable wood or non-wood pulp. Non-limitative examples of suitable pulps include any kind of chemical pulp, mechanical wood pulp, chemically treated ground pulp, CTMP (chemical thermo mechanical pulp), and/or mixtures thereof. In some examples, groundwood pulp, sulfite pulp, chemically ground pulp, refiner ground pulp, and thermo-mechanical pulp or their mixture can thus be used. In some examples, the raw base (110) contains non-wood pulp such as pulp originating from bamboo, bagasse, kenaf, papyrus, etc. Bleached hardwood chemical pulps may make up the main pulp composition. This pulp has shorter fiber structure than soft wood, which contribute to good formation of the finished paper. Fillers may also be incorporated into the pulp, for example, to substantially control physical properties of the final coated paper. The filler particles fill in the void spaces of the fiber network and result in a denser, smoother, brighter and opaque sheet. Examples of the fillers include, but are not limited to, ground calcium carbonate, precipitated calcium carbonate, titanium dioxide, kaolin clay, silicates, plastic pigment, alumina trihydrate, and/or mixtures thereof. It is to be understood that any desirable amount of filler, such as 15 wt %, may be used. In some examples, the amount of filler ranges from about 0.1 wt % to about 20 wt % of the raw base, and in some other examples, the amount of filler ranges from about 5 wt % to about 15 wt % of the raw base.

When preparing the paper base stock, internal sizing may be used. These processes may improve hydrophobicity of the cellulose fibers that in turn may control the resistance of the coated substrate to wetting, penetration, and absorption of aqueous liquids. Internal sizing may be accomplished by adding a sizing agent to the furnish containing fibers and fillers in the wet end. Non-limitative examples of suitable sizing agents include resin-based sizing agent(s), wax-based sizing agent(s), cellulose-reactive sizing agent(s) and other synthetic sizing agent(s), and/or mixtures. It is to be understood that the type and amount of surface sizing agent(s) may substantially improve moisture resistance. Surface sizing (i.e. apply surface sizing agents and other functional additives to the formatted paper surface) may be accomplished by any kind of sizing methods such as film size press, pond size press and other surface techniques. It is understood that any conventional size press agents, such as any kind of virgin starch, chemical, physical or biological modified starch is not suitable herein as all kind of starch species is not exactly meeting the desired water/moisture resistance. Without being bounded by any theory, it is believed that surface sizing composition plays dual roles for the substrates as both barrier function to the outside moisture and wet strength agent improve the wet strength when the substrate is subjected to high aqueous ink volume printing and afterwards water immersion, during application/installation. In some examples, a synthetic polymeric resin is used as the surface sizing agent. There are wide varieties of resin compositions that can be used for surface sizing. For example, the resin compositions may include, but are not limited to, resins formed by polymerization of hydrophobic addition monomers. Examples of hydrophobic addition monomers include, but are not limited to, $C_1$-$C_{12}$ alkyl acrylate and methacrylate (e.g., methyl acrylate, ethyl acrylate, n-propyl acrylate, isopropyl acrylate, n-butyl acrylate, isobutyl acrylate, sec-butyl acrylate, tert-butyl acrylate, 2-ethylhexyl acrylate, octyl arylate, methyl methacrylate, ethyl methacrylate, n-propyl methacrylate, isopropyl methacrylate, n-butyl methacrylate, isobutyl methacrylate, sec-butyl methacrylate, tert-butyl methacrylate), and aromatic monomers (e.g., styrene, phenyl methacrylate, o-tolyl methacrylate, m-tolyl methacrylate, p-tolyl methacrylate, benzyl methacrylate), hydroxyl containing monomers (e.g., hydroxyethylacrylate, hydroxyethylmethacrylate), carboxylic containing monomers (e.g., acrylic acid, methacrylic acid), vinyl ester monomers (e.g., vinyl acetate, vinyl propionate, vinylbenzoate, vinylpivalate, vinyl-2-ethylhexanoate, vinylversatate), vinyl benzene monomer, $C_1$-$C_{12}$ alkyl acrylamide and methacrylamide (e.g., t-butyl acrylamide, sec-butyl acrylamide, N,N-dimethylacrylamide), crosslinking monomers (e.g., divinyl benzene, ethyleneglycol dimethacrylate, bis(acryloylamido)methylene), and any combinations thereof. In some other examples, polymers made from the polymerization and/or copolymerization of alkyl acrylate, alkyl methacrylate, vinyl esters, and styrene derivatives may be useful. The polymers can be made using a wide variety of polymerization methods. For example, the polymers may be made using bulk polymerization, solution polymerization, emulsion polymerization, or other suitable methods. The emulsion polymerization in the presence of aqueous solvent such as water may be useful in making the polymer resins described above. In some examples, the polymer latex resin can be made using emulsion polymerization with a particle size ranging from about 0.1 to about 5 micrometers. In some other examples, the particle size may range from about 0.5 to about 3 micrometers and, in yet some other examples, the average particles size of latex resin can be of about 1.2 micrometers.

In some embodiments, inorganic fillers can be present in surface the sizing composition. The inorganic filler in the surface sizing composition can have a mean size ranging from about 0.2 micrometers to about 1.5 micrometers. These inorganic fillers can be in a powder or slurry form, and, for examples, include, but are not limited to, titanium dioxide, hydrated alumina, calcium carbonate, barium sulfate, silica, clays (such as high brightness kaolin clays), and zinc oxide. In some examples, calcium carbonate may be used. Calcium carbonate has a number of desirable properties including high brightness, gloss, opacity, good rheology, and good coating ability. In some examples, the part number of the inorganic fillers by weight per about 100 parts of polymeric resin, is ranged from about 0 to about 10 parts, and in some other examples, from about 0.5 to no more than about 5 parts. Excessive loading of inorganic fillers will reduced the penetration capability of surface sizing composition to bulk of the base substrate wet strength of the base substrate. The z-direction penetration of the surface sizing composition might be all way to the centre of the base substrate if sizing from both side, or to reach another surface in one side sizing case. In some examples, the z-direction penetration depth is over half of ⅘ of base substrate in two sides sizing and, in some other examples, the z-direction penetration depth is over half of ⅔ of base substrate in two sides sizing. It might be not desirable that penetration depth is less than ⅓ of the half of base substrate in two sides sizing. In some examples, the thickness of the surface sizing layer ranges from about 0.01 micrometer to about 3 micrometer and, in some other examples, ranges from about 0.05 micrometer to about 1 micrometer per side of the base substrate. In order to prevent penetration of moisture into the base substrate, the surface can be sized on both sides.

In some examples, since the stiffness of the raw base may be related, at least in part, to the paper thickness, or paper weight, it is to be understood that with substantially the same pulp and filler composition, the thinner the paper caliper is, the lower the paper stiffness will be. If base weight is less than 100 gsm, low flexural rigidity may generate difficulties in paper handling during printing. Customers also have lower acceptance for such a lightweight paper as photographic printout. However, if base weight is over 300 gsm, many printers cannot support such high stiffness media. In some examples, the stiffness of the raw base ranges from about 800 Gurley stiffness units to about 2000 Gurley stiffness units in the paper machine direction, and ranges from about 300 Gurley stiffness units and about 1200 Gurley stiffness units in the paper cross machine direction. In some other examples, the base paper stiffness ranges from about 800 Gurley stiffness units to about 1500 Gurley stiffness units in the paper machine direction, and from about 350 Gurley stiffness units to about 1000 Gurley stiffness units in the paper cross machine direction. A method, such as TAPPI T543 om-94, using a Gurley-type stiffness tester, may be used to determine the stiffness of the paper stock. In some examples, when the raw base (110) is a cellulose paper base, the base substrate may have a low porosity and a strong capability to resist moisture migration in view of keeping good physical strength when the recording medium is used in an high moisture environment (such as outdoor usage). In some examples, in view of reducing the moisture, absorption wet strength agents or internal sizing agents can be added to the row base.

In some examples, the recording media (100) encompasses a primary coating layer (120) that is applied directly on the base stock substrates. Such as illustrated in FIG. 1, the primary coating layer (120) can be present on one side of the recording media (100), i.e. on the image side (101) of the raw base or, in some other examples, such as illustrated in FIGS. 2 and 3, the primary coating layers (120) can be present on the back side (102) and on the image side (101) of the recording media (100), i.e. on both side of the raw base (110). Without being linked by any theory, it is believed that the function of the pigmented pre-coating layer(s) (120) is to create a smooth surface to help develop superior gloss. Additionally, the pigmented pre-coating layer(s) (120) can promote improved opacity, brightness, and appropriate color hue for the print medium. Furthermore, it is believed that primary coating layers help to enhance surface energy over base stock (especially polymer saturated base stock) so that top image receiving layer can be firmly adhered to the base stock without loading any excessive additives for adhesion improvement in the image receiving coating. In some embodiments, the primary coating layer(s) (120) includes pigment fillers and binders. The primary coating layer(s) (120) can further include surfactants and can include optional other additives. In some other embodiments, the primary coating layer(s) (120) includes a mixture of calcium carbonate and clay as pigment fillers, polymer latex as binders and surfactants.

The amount of inorganic pigment particles present in the primary coating layer (120) may be from about 40 to about 95% by weight (wt %) or may be from about 60 to about 90% by weight (wt %) based on the total weight of the coating layer (120). In some examples, the amount of binders present in the primary coating layer (120) may be from about 5 to about 60% by weight (wt %) or may be from about 10 to about 40% by weight (wt %) based on the total weight of the coating layer (120). The primary coating layer(s) (120) can be applied over the raw base (110) with a coating weight of about 5 to about 30 grams/meter$^2$ (gsm), or with a coat weight ranging from about 10 to about 15 gsm. When applied to both side of the raw base (110), the coat weight of the pre-coatings layers (120) is from about 10 to about 15 gsm for each coating sides.

In some embodiments, the image side (101) of the recording media (100) encompasses an image receiving layer (130) that is applied over the primary coating layer (120). In some examples, the image receiving layer (130) has a coat weight ranging from about 1 to about 30 grams/m$^2$; in some other examples, ranging from about 3 to about 20 grams/m$^2$ and, in yet some other examples, ranging from about 5 to about 15 grams/m$^2$. Without being liked by any theory, it is believed that the top image receiving layer (130) is used for enhancing compatibility between the ink composition containing latex and the media surface and, consequently, to improve the adhesion between the ink composition containing latex and the printing substrate. In some embodiments, the image receiving layer (130) includes pigment filler, a binder and a polymeric adhesion promoter. In some examples, the pigment filler is inorganic pigment filler. In some other examples, the polymeric binder presents in the top image receiving layer (130) is the same as the one used in the primary layer(s) (120). The amount of inorganic pigment particles present in the top image receiving layer (130) may be from about 50 to about 95% by weight (wt %) or may be from about 60 to about 90% by weight (wt %) based on the total weight of the top image receiving layer (130). The amount of binders present in the top image receiving layer (130) may be from about 10 to about 30% by weight (wt %) or may be from about 15 to 25% by weight (wt %) based on the total weight of the top image receiving layer (130). The amount of polymeric adhesion promoter present in the top image receiving layer (130) may be from about 5 to 25% by weight or may be from about 10 to 20% by weight, based on the total weight of the top image receiving layer (130). In some other examples, the amount of adhesion promoter present in the top image receiving layer (130) of the recording media, is in the range of about 5 to about 30 parts, and, in some other examples, in the range of about 5 to about 15 parts per 100 parts by dry weight of inorganic filler.

In some embodiments, the top image receiving layer (130) encompasses a polymeric adhesion promoter. Without being linked by any theory, the polymeric adhesion promoter is a substance with a macro-molecular chain structure that acts at the interface of printing media surface and ink colorant/binder particles in view of increasing the adhesion of ink colorants/binders to the printing media through the reduction of the interfacial tension. There are no specific limitations on the kinds of repeat units of macro-molecular chains and/or its side function groups. The repeat units and/or the side function groups can be either reactive, non-reactive or mixture of both. In the case that they are reactive, the adhesion promoter might chemically interact with functional groups of the ink colorants and of the printing media (by forming a covalent, an ionic or both bonds). By this way, the adhesion promoter can thus reduce or eliminate the repelling effects existing between ink colorants and printing media surface. Non-reactive polymeric adhesion promoter can also improve incompatibility among ink colorants/binders and printing media surface by means of reducing interfacial energy among the components, and subsequently improving the adhesion of the printing ink on printing media.

In some embodiments, the adhesion promoter, present in the top image receiving layer (130), is a homo-polymer or a co-polymer of alkyl acrylate, alkyl methacrylate, alkyl acrylic acid, alkyl methacrylic acid, vinyl esters, and/or styrene derivatives. Such polymers can also be in a salt form with either cationic or anionic charged molecules. In some examples, the adhesion promoter is selected from the group consisting of polymers based polyacrylate and/or polyacrylate copolymers. Examples include, but are not limited to, poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene) and poly(butyl acrylate-isoprene), poly(styrene-butadiene), poly(methylstyrene-butadiene), poly(styrene-isoprene), poly(methylstyrene-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid).

In some examples, the polymeric adhesion promoter is a polymeric salt. The electric charge of said polymer can be neutral, cationic or anionic. In some examples, the polymer is a cationic polymer in view of having a good reaction with anionic charged ink pigments. Examples includes, but are not limited to, polymeric salts of trimethyl-ammoniumethyl acrylate, trimethyl-ammoniumethyl methacrylate, trimethyl-ammoniumethyl acrylate; trimethyl-ammonium-ethyl methacrylate, dimethyl-benzylammoniumethyl acrylate, dimethyl-benzylammoniumethyl methacrylate, dimethyl-butylammonium-ethyl acrylate, dimethylbutylammoniumethyl methacrylate, dimethylhexylammoniumethyl acrylate, dimethylhexylammoniumethyl methacrylate, dimethyloctylammoniumethyl acrylate, dimethyl-octylammoniumethyl methacrylate, dimethyldodeceylammoniumethyl acrylate and dimethyldocecylammoniumethyl methacrylate, trimethyl-(4-vinylbenzyl)ammonium, triethyl-(4-vinylbenzyl) ammonium, trimethyl-ammoniumpropyl acrylate, dimethyloctadecyl-ammoniumethyl acrylate, and dimethyloctadecylammoniumethyl methacrylate. The counter-ions of these cationic polymers can be chloride, bromide, methylsulfate, triflate, etc.

In some examples, the adhesion promoter is an aqueous emulsion in the form of latex particles. Such latex adhesion promoter compositions may include those prepared using emulsion co-polymerization of various ratios of monomer such as, but in no way limited to, methyl methacrylate, styrene, with various 'soft' acrylate esters, and functionalized monomers. These functionalized monomers include 'vinyl' monomers containing hydroxyl groups, carboxylic acids, sulfonic or sulfate acids and phosphate acids. As used herein, 'vinyl' denotes derivatives of acrylates, methacrylates, functionalized styrene, allyl ether and esters, vinyl ethers as selected examples. Co-polymers can be formed, including block copolymers, randomly assembled copolymers, cross-linkable copolymers, or the like. In some other examples, the adhesion promoter is a polyacrylate-styrene copolymer or a polymethyl acrylic-styrene copolymer in the form of latex particles.

Latex adhesion promoter particles can utilize a measured amount of surface acid groups to provide stability over longer periods of time (to resist aggregation) and to provide improved adhesion to certain polar interfaces. In a more detailed aspect, the latex particles can be prepared using various monomers as sources of acid functionality. In use, polymeric acid functionalities are neutralized to provide a latex particle surface charge. Acid functionality may include ionizable groups such as carboxylic acids, sulfonic or sulfate acids and phosphate acids. In some examples, the amount of the co-polymerized surface acid co-monomer can ranged from about 0.01 to about 10% of total monomers.

In some examples, the adhesion promoter is not a water soluble polymer. It is meant thus that the adhesion promoter polymer does not have a solid content change, in an aqueous solvent under room temperature and pressure that is greater than 5% by weight with a period of 24 hours. In some other examples, the adhesion promoter is a water dispersible polymer. The adhesion promoter can be dispersed into small particles of diameter in the range of about 100 to about 500 nanometer (nm), with or without external shear force, in view of forming a stable emulsion with or without aid of an emulsifier. Alternatively, in some examples, the adhesion promoter can form in-situ latex particles via emulsion polymerization with particle size in the range of about 100 to about 500 nanometer (nm). In some examples, the adhesion promoter is an acrylic latex composition in the form of latex particles. In some examples, the adhesion promoter can have a molecular weight in the range of about 10,000 Mw to about 5,000,000 Mw as measured by GPC. In some example, the adhesion promoter polymer has a glass transition temperature (Tg) that is at 90° C., or higher than 90° C. In some other examples, the adhesion promoter polymer has a glass transition temperature (Tg) that is at 95° C., or higher, than 95° C. The way of measuring the glass transition temperature (Tg) parameter is described in, for example, Polymer Handbook, 3rd Edition, authored by J. Brandrup, edited by E. H. Immergut, Wiley-Interscience, 1989.

Latexes include both latex particulates as well as the aqueous medium in which the latex particulates are dispersed. More specifically, latex is a liquid suspension comprising a liquid (such as water and/or other liquids) and polymeric particulates ranging from about 20 nm to about 500 nm. In some other examples, the adhesion promoter is an aqueous emulsion in the form of latex particles wherein the latex particle size ranges from about 150 to about 350 nanometers. In yet some other examples, the adhesion promoter is an aqueous emulsion in the form of latex particles wherein the latex particle size ranges from about 150 to about 350 nanometers and have a glass transition temperature at, or above, 90 degrees C.

In some examples, the polymeric adhesion promoter has a similar or identical chemical structure, a similar or identical molecular weight and a similar or identical weight distribution as the binder used in the ink composition containing latex. In some other examples, the difference of solubility parameters between ink latex binder and polymeric adhesion promoter is less than 0.8 $(cal \cdot cm^{-3})^{1/2}$, and, in yet some other examples, is less than 0.2 to 0.5 $(cal \cdot cm^{3})^{1/2}$. The test is based on "Estimation of polymer solubility parameters by Inverse gas chromatography", Macromolecular 1982, 15, 622-624. In some embodiments, the adhesion promoter component is a latex component that is identical to the latex component used in the ink composition that is printed on the recording medium.

In some examples, when the polymeric adhesion promoter is in aqueous dispersed latex form, its minimum film forming temperature (MFFT) is at, or not less, than 80° C. The minimum film forming temperature (MFFT) is defined as the minimum temperature at which the water-borne synthetic latex or emulsion will coalesce when laid on a substrate as a thin film, and is determined by the use of a MFFT Bar with the test condition described in ASTM D 2354. Such parameters indicate that at room temperature, the polymeric adhesion promoter has no binding power to the inorganic pigment fillers and to the primary coating layers and substrates. Within such condition, the dispersed particles neither has deformed nor is forming a continuous film to provide any adhesion to filler particles and substrate.

It is noticed that chemical structure as defined by type and amount monomers and co-monomers which form the polymer only play partially vital roles to the properties of adhesion promoter, and other macromolecular structure such as molecular weight and polymer morphology controlled properties like particles size, Tg and MFFT also dominates suitability of a polymer as the said adhesion promoter. In some examples, the MW, Tg and MFFT of promoter are controlled to a level at which it has no any binding power across use temperature range from media storage to using temperature. Under such structural characteristic, the polymeric adhesion promoters keep their glassy molecular state against any big range molecular movement, structure deformation and film-forming. If the MW, Tg and MFFT is decreased to the level which normal coating binder has, it will adversely soften latex ink film and make printing durability decreasing.

In some examples, the primary coating layer(s) (120) and the top image receiving layer (130) include, at least, one filler. The filler, used in the top image receiving layer (130), is independently selected from the one used in the primary coating layer(s) (120). The primary coating layer(s) (120) and the top image receiving layer (130) can include a mixture of two or more pigment fillers with different particle size and size distribution. In some examples, such fillers are inorganic pigments. Examples of inorganic pigments include metal oxides and/or semi-metal oxides particles. The inorganic pigments may also be independently selected from the group consisting of calcium carbonate, zeolite, silica, talc, alumina, boehmite, silicates (such as aluminum silicate, magnesium silicate and the like), aluminum trihydrate (ATH), titania, zirconia, clays, calcium silicate, kaolin, calcined clay or combinations thereof. In some examples, the inorganic pigments are calcium carbonate, precipitated calcium carbonate, ground calcium carbonate, kaolin clays, and others. The physical form of the pigments can be either powder or aqueous pre-dispersed slurry. Optionally, co-pigments can be present in the primary coating layer(s) (120) and in the top image receiving layer (130). Such co-pigments include, for example, pigments that have both a micro-porous structure, such as fumed silica and silica gels, and "structured" pigments. Examples of these structured pigments are calcined clays and porous clays/calcium carbonate that are reaction products of clay/calcium carbonate with colloidal silica. Other inorganic particles such as particles of titanium dioxide ($TiO_2$), silicon dioxide ($SiO_2$), aluminum trihydroxide (ATH), calcium carbonate ($CaCO_3$) and zirconium oxide ($ZrO_2$) can be inter-calcined into the structured clay or calcium carbonates. Co-pigment particles may be substantially non-porous mineral particles that have a special morphology that can produce a porous coating structure when solidified into a coating layer. In some examples, such particles are aragonite precipitated calcium carbonates. In some other examples, the particles have a needle-like structure on a microscopic scale, i.e. they have a high aspect (length-to-width) ratio. This structure results in a loose coating layer packing with a relatively large fraction of voids on the coating surface.

In some examples, the primary coating layer(s) (120) and the top image receiving layer (130) include, at least, a polymeric binder. The polymeric binder of the top image receiving layer (130) is independently selected from the one used in the primary coating layer(s) (120). In some examples, the polymeric binder can be either water a soluble, a synthetic or a natural substances or an aqueous dispersible substance like polymeric latex. In some other examples, the polymeric binder is polymeric latex. Without being linked by any theory, it is believed that the polymeric binder is used to provide adhesion among the inorganic particles and other components within the image receiving layer (130) and within the primary coating layer(s) (120). The polymeric binder is also used to provide adhesion between the image receiving layer (130) and the primary coating layer(s) (120), as well as the adhesion between primary coating layer(s) and base substrate (110). The polymeric binder can be a water soluble polymer or water dispersible polymeric latex. In some examples, the binder is selected from natural macromolecule materials such as starches, chemical or biological modified starches and gelatins. The binder may be selected from the group consisting of water-soluble binders and water dispersible polymers that exhibit high binding power for base paper stock and pigments, either alone or as a combination. In some examples, the polymeric binder components have a glass transition temperature (Tg) ranging from −10° C. to +50° C. The way of measuring the glass transition temperature (Tg) parameter is described in, for example, Polymer Handbook, 3rd Edition, authored by J. Brandrup, edited by E. H. Immergut, Wiley-Interscience, 1989.

Suitable binders include, but are not limited to, water soluble polymers such as polyvinyl alcohol, starch derivatives, gelatin, cellulose derivatives, acrylamide polymers, and water dispersible polymers such as acrylic polymers or copolymers, vinyl acetate latex, polyesters, vinylidene chloride latex, styrene-butadiene or acrylonitrile-butadiene copolymers. Non-limitative examples of suitable binders include styrene butadiene copolymer, polyacrylates, polyvinylacetates, polyacrylic acids, polyesters, polyvinyl alcohol, polystyrene, polymethacrylates, polyacrylic esters, polymethacrylic esters, polyurethanes, copolymers thereof, and combinations thereof. In some examples, the binder is a polymer and copolymer selected from the group consisting of acrylic polymers or copolymers, vinyl acetate polymers or copolymers, polyester polymers or copolymers, vinylidene chloride polymers or copolymers, butadiene polymers or copolymers, styrene-butadiene polymers or copolymers, acrylonitrile-butadiene polymers or copolymers. In some other examples, the binder component is a latex containing particles of a vinyl acetate-based polymer, an acrylic polymer, a styrene polymer, an SBR-based polymer, a polyester-based polymer, a vinyl chloride-based polymer, or the like. In yet some other examples, the binder is a polymer or a copolymer selected from the group consisting of acrylic polymers, vinyl-acrylic copolymers and acrylic-polyurethane copolymers. Such binders can be polyvinylalcohol or copolymer of vinylpyrrolidone. The copolymer of vinylpyrrolidone can include various other copolymerized monomers, such as methyl acrylates, methyl methacrylate, ethyl acrylate, hydroxyethyl acrylate, hydroxyethyl methacrylate, ethylene, vinylacetates, vinylimidazole, vinylpyridine, vinylcaprolactams, methyl vinylether, maleic anhydride, vinylamides, vinylchloride, vinylidene chloride, dimethylaminoethyl methacrylate, acrylamide, methacrylamide, acrylonitrile, styrene, acrylic acid, sodium vinylsulfonate, vinylpropionate, and methyl vinylketone, etc. Examples of binders include, but are not limited to, polyvinyl alcohols and water-soluble copolymers thereof, e.g., copolymers of polyvinyl alcohol and poly(ethylene oxide) or copolymers of polyvinyl alcohol and polyvinylamine; cationic polyvinyl alcohols; aceto-acetylated polyvinyl alcohols; polyvinyl acetates; polyvinyl pyrrolidones including copolymers of polyvinyl pyrrolidone and polyvinyl acetate; gelatin; silyl-modified polyvinyl alcohol; styrene-butadiene copolymer; acrylic polymer latexes; ethylene-vinyl acetate copolymers; polyurethane resin; polyester resin; and combination thereof. Examples of binders include Poval®235, Mowiol®56-88, Mowiol®40-88 (products of Kuraray and Clariant).

The binder may have an average molecular weight (Mw) of about 5,000 to about 500,000. In some examples, the binder has an average molecular weight (Mw) ranging from about 100,000 to about 300,000. In some other examples, the binder has an average molecular weight of about 250,000. The average particle diameter of the latex binder can be from about 10 nm to about 10 μm; in some other examples, from about 100 nm to about 5 μm; and, in yet other examples, from about 500 nm to about 0.5 μm. The particle size distribution of the binder is not particularly limited, and either binder having a broad particle size distribution or binder having a mono-dispersed particle size distribution may be used. The binder may include, but is in no way limited to latex resins sold under the name Hycar® or Vycar® (from Lubrizol Advanced Materials Inc.); Rhoplex® (from Rohm & Hass company); Neocar® (from Dow Chemical Comp); Aquacer® (from BYC Inc) or Lucidene® (from Rohm & Haas company).

The primary coating layer(s) (120) and the top image receiving layer (130) may further include optional additives such as mordants, biocides, surfactants, plasticizers, rheology modifiers, defoamers, optical brighteners, pH controlling agents, and other additives for further enhancing the properties of the coating. Among these additives, rheology modifier is useful for addressing runnability issues. Suitable rheology modifiers include polycarboxylate-based compounds, polycarboxylated-based alkaline swellable emulsions, or their derivatives. The rheology modifier is helpful for building up the viscosity at certain pH, either at low shear or under high shear, or both. In certain embodiments, a rheology modifier is added to maintain a relatively low viscosity under low shear, and to help build up the viscosity under high shear. It is desirable to provide a coating formulation that is not so viscous during the mixing, pumping and storage stages, but possesses an appropriate viscosity under high shear. Some examples of rheology modifiers that meet this requirement include, but are not limited to, Sterocoll® FS (from BASF), Cartocoat® RM 12 (from Clariant), Acrysol® TT-615 (from Rohm and Haas) and Acumer® 9300 (from Rohm and Haas). The amount of rheology modifier in the coating composition may be in the range of about 0.1 to about 2 parts, in some other examples, in the range of about 0.1 to about 0.5 parts based on 100 parts of inorganic pigments. In some embodiments, the primary coating layer(s) (120) includes surfactants. There is no specific limitation on the chemical structure of surfactant used in the primary coating layer. In some examples, polyalkylene oxide based surfactant such as Surfynol® (supplied by Air Product), or the silicone base surfactants (BYK® surfactants supplied by BYK Inc) can be used in said coating layer.

In some examples, the recording media (100) encompasses on the back side (102) of the row base substrate (110), an adhesive layer (140). Such as illustrated in FIG. 3, the adhesive layer (140) can be present on the back side (102) of the row base substrate (110) above the primary coating layer (120). Such adhesive coating layer (140) can contain partially water soluble macromolecules chemicals such as partially esterified polyvinyl alcohol, partially cross-linked PVA with low or medium molecular weight, and chemical modified starches. In some examples, polyacrylic acid and cross-linked polyacrylic acid can be present in the adhesive layer (140). In some other examples, inorganic filler can be present in an amount representing less than about 50% by weight of the total adhesive layer. Some functional additives, such as surface color dye and PH adjuster, can also be present. Without being linked by any theory, it is believed that the function of the adhesive coating layer (140) is to create some conveniences to the end user of the printing products who can, for example, readily place the printed media on any substrate like wall, glass surface, paper or plastic broad for displaying. In some examples, such adhesive layer helps the printed media to be "removable or repositionable" (like a sticker). In some other examples, such adhesive layer make the printed media "strippable", meaning thus that the printed media can be easily removed from any substrate (like a wall) without damage the substrate located below, such as the painting.

In some embodiments, the present disclosure refers to a method of making a recording media. Such method encompasses applying a primary coating layer (120) on the image side of a raw base substrate (110); drying the primary coating layer (120); applying a top image receiving layer (130) over said primary coating layer, drying and calendaring said layers. In some other examples, the method encompasses: applying primary coating layers (120) on both side of a raw base substrate (110); drying the primary coating layers (120); applying a top image receiving layer (130) over one side of said a primary coating layer, drying and calendaring said layers. In both methods, the image receiving layer (130) encompasses polymeric adhesion promoter with a glass transition temperature (Tg) that is at 90° C. or higher than 90° C. In yet some other examples, an adhesive layer (140) is applied on the back side (102) of a raw base substrate (110), over the primary coating layer (120).

The primary coating layer(s) (120), the top image receiving layer (130) and adhesive layer (140), when present, may be applied to the supporting substrate (110) using any one of a variety of suitable coating methods, such as blade coating, air knife coating, metering rod coating, curtain coating, or another suitable technique. In some examples, blade-coating, metering rod coating or run the coating process at high speed are used. For a double-side coated medium, depending on the set-up of production machine in a mill, both sides of the substrate may be coated during a single manufacture pass, or alternatively, each side may be coated in separate passes. After the coating step, the coated medium can be subjected to a drying process to remove water and other volatile components in the coating layers and substrate. The drying means includes, but are not limited to, infrared (IR) dryers, hot surface rolls, and hot air floatation dryers. After coating, the coated medium may be calendered to increase glossiness and/or to impart a satin surface. When a calendering step is incorporated, the coated medium may be calendered by an on-line or an off-line calender machine, which may be a soft-nip calender or a super-calender. The rolls, in a calendar machine, may or may not be heated, and pressure is usually applied to the calendering rolls. In some examples, the primary coating layer(s) (120), the top image receiving layer 130 and the adhesive layer (140) are coated onto the base substrate (110) using any method known in the art including size press, slot die, curtain coating, blade coating and Meyer rod. The size presses include puddle-sized press, film-sized press and the like. The puddle-sized press can be configured as having horizontal, vertical, or inclined rollers. The film-sized press can include a metering system, such as gate-roll metering, blade metering, Meyer rod metering, or slot metering. In some examples, a film-sized press with short-dwell blade metering can be used as an application head to apply a coating solution. In some examples, a film-sized press is used to apply the ink receiving layer (130) to a paper substrate. The image receiving layer (130) can be applied to paper substrate off-line or in-line of a paper-making machine.

In some embodiments, the present disclosure refers to printing method for producing durable images on a recording media such as defined above. In some examples, said method encompasses: obtaining a recording media containing a raw base substrate (110) having, on its image side, a primary coating layer (120) and a top image receiving layer (130) wherein said image receiving layer encompasses a polymeric adhesion promoter having a glass transition temperature (Tg) ranging at, or above, 90° C.; jetting an ink composition containing latex onto said recording media, to form a printed image with enhanced image quality and enhanced image permanence. Said method might further encompass the step of drying the printed image. In some examples, the polymeric adhesion promoter is in the form of latex particles having a size ranging from about 150 to about 350 nanometers with a glass transition temperature ranging at, or above, 90 degrees C. In some other embodiments, the ink composition used in said method, contains a latex component that is identical to the polymeric adhesion promoter present in the image receiving layer (130).

The recording media according to embodiments of the present disclosure, when used in inkjet printing with ink composition containing latex, imparts good image quality, improved durability and excellent adhesion performances. Without being bound by the theory, it is believed that the polymer adhesion promoter present in the recording media, when used in printing method using latex-based inks (i.e. printed with ink composition containing latex), act synergistically with the ink composition containing latex in view of providing printed image with improved adhesion property. The printed image will have a superior adherence and enhanced image permanence when printed in such recording media. Furthermore, when the ink composition encompasses a latex component that is identical to the polymeric adhesion promoter present in the top image receiving layer (130), the resulting printed image provides enhanced inkjet image quality and enhanced image permanence.

The polymers adhesion promoter present in the image receiving layer (130) of the recording media, provides thus media having the good capacity for receiving and retaining the ink. When printed with ink compositions containing latex, embodiments of the inkjet recording media provides good image quality and enhanced image adhesion to said media. Thus, the recording media (100), when used in an inkjet printing process, provides good image quality and has a structure which is receptive and which presents excellent adherence properties to the ink deposed thereon. In some examples, the present disclosure relates thus to a method for forming printed images on ink recording media such as defined herein, using a inkjet ink composition containing latex. In some other examples, the method of forming printed images on ink recording media, such as defined herein, using the latex ink composition is done in a heated environment. The method encompasses the step of projecting a stream of droplets of the ink composition onto said ink recording media to form the desired printed image. The ink composition containing latex may be established on the media via any suitable inkjet printing technique. Non-limitative examples of such inkjet printing techniques include thermal, acoustic, continuous and piezoelectric inkjet printing. In some embodiments, the inkjet recording media is used with any suitable inkjet printer and with any ink composition containing latex that is ordinarily used for inkjet printing. Examples of such printers are HP L25500 and HP L65500 (Hewlett-Packard Corporation).

By inkjet composition, it is meant herein that the composition is very well adapted to be used in an inkjet printing device and/or in an inkjet printing process. As latex ink composition or latex-based ink composition, it is meant herein an ink composition containing polymeric latex. Thus, in some embodiments, the media of the present disclosure is used in combination with an ink composition containing latex. The ink composition used herein is, therefore, a composition comprising polymeric latex. In some examples, the polymeric latex is suspended or dissolved in an ink vehicle. In some examples, the inkjet ink composition containing latex encompasses polymeric latex. The polymeric latex refers herein to a group of preparations consisting of stable dispersion of polymeric micro-particles dispersed in the aqueous vehicle of the ink. The polymeric latex can be natural latex or synthetic latex. Synthetic latexes are, usually, produced by emulsion polymerization using a variety of initiators, surfactants and monomers. In some examples, the polymeric latex is cationic, anionic, or amphoteric polymeric latex. Any latex polymer commercially available can be used in the inks described herein including self-dispersed and functionalized latex polymers. Latex polymers can be prepared using any of a number of known emulsion polymerization techniques where co-monomers are dispersed and polymerized in a discontinuous phase of an emulsion. Monomers that are often used include ethyl acrylate; ethyl methacrylate; benzyl acrylate; benzyl methacrylate; propyl acrylate; propyl methacrylate; iso-propyl acrylate; iso-propyl methacrylate; butyl acrylate; butyl methacrylate; hexyl acrylate; hexyl methacrylate; octadecyl methacrylate; octadecyl acrylate; lauryl methacrylate; lauryl acrylate; hydroxyethyl acrylate; hydroxyethyl methacrylate; hydroxyhexyl acrylate; hydroxyhexyl methacrylate; hydroxyoctadecyl acrylate; hydroxyoctadecyl methacrylate; hydroxylauryl methacrylate; hydroxylauryl acrylate; phenethyl acrylate; phenethyl methacrylate; 6-phenylhexyl acrylate; 6-phenylhexyl methacrylate; phenyllauryl acrylate; phenyllauryl methacrylate; 3-nitrophenyl-6-hexyl methacrylate; 3-nitrophenyl-18-octadecyl acrylate; ethyleneglycol dicyclopentyl ether acrylate; vinyl ethyl ketone; vinyl propyl ketone; vinyl hexyl ketone; vinyl octyl ketone; vinyl butyl ketone; cyclohexyl acrylate; methoxysilane; acryloxypropyhiethyldimethoxysilane; trifluoromethyl styrene; trifluoromethyl acrylate; trifluoromethyl methacrylate; tetrafluoropropyl acrylate; tetrafluoropropyl methacrylate; heptafluorobutyl methacrylate; iso-butyl acrylate; iso-butyl methacrylate; 2-ethylhexyl acrylate; 2-ethylhexyl methacrylate; iso-octyl acrylate; and iso-octyl methacrylate.

In some examples, the latexes used herein are prepared by latex emulsion polymerization, and, in some other examples, have a weight average molecular weight ranging from about 10,000 Mw to about 5,000,000 Mw. In some examples, the polymeric latex is selected from the group consisting of acrylic polymers or copolymers, vinyl acetate polymers or copolymers, polyester polymers or copolymers, vinylidene chloride polymers or copolymers, butadiene polymers or copolymers, styrene-butadiene polymers or copolymers, acrylonitrile-butadiene polymers or copolymers. In some examples, the polymeric latex liquid suspension contains a liquid (such as water and/or other liquids) and polymeric latex particulates having a size ranging from about 20 nm to about 500 nm. In some other examples, the polymeric latex particulates have a size ranging from about 100 nm to about 300 nm. In yet some other examples, the polymeric latex particulates have a weight average molecular weight ranging from about 10,000 Mw to about 5,000,000 Mw, or, ranging from about 40,000 Mw to about 100,000 Mw.

The ink composition can contain polymeric latex particulates in an amount representing from about 0.5 wt % to about 15 wt % based on the total weight of the ink composition. The polymeric latex particulates might contain a plurality of monomers that are often randomly polymerized, and that can be crosslinked. When crosslinked, the molecular weight can be even higher than the molecular weight cited above. Examples of polymeric latex particulates that can be used include those prepared using a mix of monomer of various weight ratios. Examples of such monomers include styrene, hexyl methacrylate, ethylene glycol dimethacrylate and methacrylic acid. All these monomers could be copolymerized to form latex. In some examples, polymeric latex particulates contain styrene and hexyl methacrylate monomers that can provide the bulk of the latex particulate, and ethylene glycol dimethacrylate and methyl methacrylate that can be copolymerized therewith in smaller amounts. In such examples, the acid group is provided by the methacrylic acid. Other combinations of monomers can similarly be used to form latex particulates. Non-limiting examples of monomers that can be used to form such particulates include, but are in no way limited to, styrenes, $C_1$ to $C_8$ alkyl methacrylates, $C_1$ to $C_8$ alkyl acrylates, ethylene glycol methacrylates and dimethacrylates, methacrylic acids, acrylic acids, and the like.

In some embodiments, the ink composition includes polymeric latex that have a particle size ranging from about 150 to about 350 nanometers and that have a glass transition temperature (Tg) ranging at or above 90 degrees C. In some other examples, the latex component of the ink composition is identical to the polymeric adhesion promoter component that is present in the top image receiving layer (130) of the recording media on which the ink is printed onto. In some other examples, the latex component of the ink composition is a polyacrylate-styrene copolymer or a polymethyl acrylic-styrene copolymer. In some examples, the difference of solubility parameters between ink latex binder and polymeric adhesion promoter is less than 0.8 $(cal \cdot cm^{-3})^{1/2}$, and, in some other examples, is less than 0.2 to 0.5 $(cal \cdot cm^{-3})^{1/2}$. The test is based on "Estimation of polymer solubility parameters by Inverse gas chromatography", Macromolecular 1982, 15, 622-624.

Without being linked by any theory, it is believed that, when the ink composition containing latex is jetted onto the recording media such as defined herein, discrete polymer particles are laid down on the media surface followed up by a drying processing. It is also believed that, when aqueous solvent is lost from the drops while ink drying, the mutual repulsive forces, associated with the surfactants, inhibit the close packing of the particles and a cubic arrangement of the particles is firstly formed. As the aqueous solvent continues to evaporate, the particles become close packed with a solids volume of around 70% or higher. When most of the water is lost from the system, the inter-particular repulsive forces are overcome by increasing surface tension and the particles coalesce into a discrete film. The film-forming depends then upon the elastic modulus of the ink latex as the resistance to particle deformation.

In some examples, the ink composition referred herein contains one or more colorants that impart the desired color to the printed message. As used herein, "colorant" includes dyes, pigments, and/or other particulates that may be suspended or dissolved in an ink vehicle. The colorant can be present in the ink composition in an amount required to produce the desired contrast and readability. In some other examples, the ink compositions include pigments as colorants. Pigments that can be used include self-dispersed pigments and non self-dispersed pigments. Any pigment can be used; suitable pigments include black pigments, white pigments, cyan pigments, magenta pigments, yellow pigments, or the like. Pigments can be organic or inorganic particles as well known in the art. As used herein, "liquid vehicle" is defined to include any liquid composition that is used to carry colorants, including pigments, to a substrate. A wide variety of liquid vehicle components may be used and include, as examples, water or any kind of solvents. Such liquid vehicles may further include a mixture of different agents, including without limitation, surfactants, solvents and co-solvents, buffers, biocides, viscosity modifiers, sequestering agents, stabilizing agents and water. Though not liquid per se, the liquid vehicle can also carry other solids, such as polymers, UV curable materials, plasticizers, salts, etc.

In some embodiments, such as illustrated in FIGS. 4, 5 and 6, the present disclosure refers to a printed article (200) containing a recording media (100), such as defined herein, on which a printed feature (210) has been formed with an ink composition containing latex. Said recording media is an inkjet recording media with a raw base substrate (110) comprising, on its image side, a primary coat layer (120) and a top image receiving layer (130) wherein said image receiving layer encompasses a polymeric adhesion promoter having a Tg that is at, or above, 90° C. The ink composition, used to print the printed feature (210), encompasses latex components that have a glass transition temperature (Tg) that is at, or above, 90° C. In some examples, the printed feature (210) is printed over the printed media (100), such as defined herein, and has been formed with an ink composition containing a latex component wherein the difference of solubility parameters between the latex component of the ink composition and the polymeric adhesion promoter, of the inkjet recording media, is less than 0.8 $(cal \cdot cm^{-3})^{1/2}$. In some other examples, printed feature (210) is printed over the printed media (100) such as defined herein and has been formed with an ink composition containing a latex component, wherein said latex component is identical to the polymeric adhesion promoter present in the image receiving layer of the inkjet recording media.

EXAMPLES

Ingredients:

Pluronic®L61 is a surfactant available from BASF

Dynwet® 800 is a surfactant available from BYK Inc.

BYK®024 is a defoamer available from BYK Inc.

Ammonium Hydroxide is a pH adjuster.

Acrumer® 9300 is a dispersing agent available from Dow Co.

Hydrocarb® H60 is coarse $CaCo_3$ slurry available from Omya Inc.

Hydrocarb® H90 is Fine $CaCo_3$ slurry available from Omya Inc.

Joncryl®98 is Polyacrylate copolymer latex available from BASF Co.

All Purpose Cleaner® is a mixture containing dimethyl benzyl ammonium chloride and alkyl compounds available from Clorox Co Crodafos® N-3 acid is available from Croda Inc.

Tergitol® 15s12 is a surfactant available from Talas Inc.

Chemguard S-550® is a fluorosurfactant available from Chemguard.

MPDiol Glycol is 2-methyl-1,3-propanediol available from Lyondell Basell.

Cab-O-Jet® 300 is a self dispersed pigment available from Cabot Corporation

Example 1—Preparation of Recording Media

Recording media, according to the present disclosure, and comparative media are prepared. Media A, B and C are ink recording media such as described in the present disclosure. Media D, E and F are comparative media. Media A to F are prepared, each including a base paper substrate, a primary coating layer and a top image receiving layer.

The base paper stocks used in the recording media A, B, C, D, E and F are made from cellulose fibers which contains about 78 wt % virgin fibers, about 10 wt % of post-consume fibers and about 12 wt % of calcium carbonate fillers. The base paper stock is then surface sized using an acrylic latex resin. The basis weight of the base paper stock is 165 gsm. The media is then coated, on both sides, with a primary coating layer using a pilot coater equipped with a rod measuring device. The primary coating layer contains about 85 parts by weight of calcium carbonate fillers, about 15 parts by weight of polymeric latex binder with acrylic-styrene copolymer and about 5 parts by weight of additives.

(The additives include Pluronic®L61, Dynwet®800, BYK®024, Ammonium Hydroxide, Propylene Glycol and Acrumer®9300.) A top image receiving layer is then applied, using a pilot coater equipped with rod measuring device, running at a speed of 800 ft/min, on the image side of the media. Different image-receiving layer compositions are prepared in accordance with the formula such as illustrated in the TABLE 1 below. All amounts are expressed in parts by weight. The image receiving layers are then coated on the recording media in view of producing recording media A, B, C, D, E and F. Different Polymeric adhesion promoters (I, II, III and IV) are used.

TABLE 1

| Image receiving layer formulation | A | B | C | D | E | F |
|---|---|---|---|---|---|---|
| Hydrocarb ® H60 | 90 | 90 | 90 | 90 | 90 | 90 |
| Hydrocarb ® H90 | 10 | 10 | 10 | 10 | 10 | 10 |
| Joncryl ® 98 | 18 | 18 | 18 | 18 | 18 | 18 |
| Polymeric adhesion promoter I | 10 | — | 15 | — | — | — |
| Polymeric adhesion promoter II | — | 10 | — | — | — | — |
| Polymeric adhesion promoter III | — | — | — | — | 10 | — |
| Polymeric adhesion promoter IV | — | — | — | — | — | 10 |
| Dynwet ® 800 | 0.5 | 0.5 | 0.5 | 0.5 | 0.5 | 0.5 |
| BYK ® 024 | 0.1 | 0.1 | 0.1 | 0.1 | 0.1 | 0.1 |

TABLE 2 illustrates some parameters in relation with the polymeric adhesion promoters I, II, III and IV: chemical structure, Tg and Delta (in relation with solubility parameters). The Delta (solubility parameter) represents the difference of solubility parameters between the latex part of the ink composition (used to be printed onto the media) and the polymeric adhesion promoter present in the recording media. This means thus that, when the polymeric adhesion promoter is identical to the latex in ink formulation, the value of the Delta solubility parameters is 0 (as illustrates with the polymeric adhesion promoter I). The Delta is expressed in $(cal \cdot cm^{-3})^{1/2}$. The solubility parameters test is based on "Estimation of polymer solubility parameters by Inverse gas chromatography", Macromolecular 1982, 15, 622-624.

TABLE 2

| Polymeric adhesion promoter | Chemical definition | Tg (° C.) | Delta (solubility parameter) |
|---|---|---|---|
| I | Polyacrylate-styrene copolymer in latex form. | +90° C. | 0 |
| II | Polymethyl acrylic-styrene copolymer in latex form | +92° C. | 0.3 |
| III | Polybutyl-styrene copolymer in latex form | −5° C. | 0.2 |
| IV | Water dispersed polymer with epoxy structure | +90° C. | 1.8 |

Example 2—Recording Media Performances

Recording media A to F, obtained in Example 1, are evaluated for their printing performances, specifically for their ink adhesion performances. Media A to F are tested in combination with the black ink such as illustrated in TABLE 3 below. All percentages are expressed in percentage by weight (wt %) based on the total weight of the ink composition. The latex component of the ink composition is a polyacrylate-styrene copolymer in latex form (i.e. the polymeric adhesion promoter of formula I).

TABLE 3

| Component | Amount (wt %) |
|---|---|
| Cab-O-Jet ® 300 | 3.50 |
| Latex component | 8.00 |
| 2-Pyrrolidone | 16.00 |
| MPDiol | 9.00 |
| Chemguard S-550 ® | 0.75 |
| Crodafos ® N-3 acid | 0.20 |
| Tergitol ® 15s12 | 0.35 |
| Water | Up to 100 |

An identical image sequence is printed on the recording media A, B, C, D, E and F with the black ink of TABLE 3, using a HP DesignJet L25500 Printer, (equipped with HP 789 ink cartridges). The printer is set with a heating zone temperature at about 50° C., a cure zone temperature at about 110° C., and an air flow at about 15%. Adhesion tests and ink running test are performed onto the printed media.

The ink adhesion tests are done using an abrasion scrub tester (per ASTM D4828 method). Both print sample and test probe are immerse in water or in an organic solvent (409 All Purpose Cleaner®. The amount of the ink remaining on the printed media is determined by measurement of the ink OD transferred on test probe. Good adhesion, upon immersion, will tend not to transfer ink from a printed image and the black optical density (KOD) will be maintained (A high OD indicates a worse ink adhesion). The ink water durability (or ink running test) is determined by immersing the printed sample into water and soaking it for 2 min. The ink running results are then visually evaluated after scratching the printing surface with a wet sponge followed by a shear force scratching using a striper. For ink running performances, each sample is ranked against other samples, and is then labeled with a relative score wherein: 5 is given to sample having no visible ink running; 4 to sample having very minor ink running; 3 to sample having minor ink running with acceptable level; 2 to sample having ink running at reject level; and 1 to sample having significant ink running.

Image quality is determined in terms of parameters such as gamut, black and color ink density, L*min, ink bleed level and ink coalescence. The image gamut, black and color ink density, L*min and black optical density (KOD) are measured on Macbeth® TD904 (Macbeth Process measurement). The image quality of the prints related with ink migration such as bleeding and coalescence, are evaluated visually from the printed samples.

The results are illustrated in TABLE 4. According to these results, it is clear that good printing performances are obtained when the recording media contains polymeric ink adhesion promoter such as described herein.

TABLE 4

| | Ink running | Ink adhesion (ink OD) in water | Ink adhesion (ink OD) in 409 cleaner ® | Coalescence | Gamut |
|---|---|---|---|---|---|
| A | 5 | 3.0 | 4.2 | Good | 347500 |
| B | 5 | 3.6 | 4.0 | Good | 346000 |
| C | 4+ | 4.1 | 4.2 | good | 347100 |
| Comp. D | 4 | 3.7 | 13.2 | good | 345200 |
| Comp. E | 5 | 4.6 | 9.8 | good | 345800 |
| Comp. F | 3 | 5.9 | 15.2 | good | 348800 |

The invention claimed is:

1. A recording media, comprising:

a raw base substrate having an image side;

a primary coating layer disposed on the image side, the primary coating layer having a coating weight of from about 10 gsm to about 30 gsm, and the primary coating layer comprising:

inorganic pigment particles in an amount of from about 60 wt % to about 90 wt % based on a total weight of the primary coating layer; and a binder in an amount of from about 10 wt % to about 40 wt % based on the total weight of the primary coating layer; and a top image receiving layer disposed on the primary coating layer, the image receiving layer comprising:

a pigment consisting of an inorganic pigment filler present in an amount of from about 60 wt % to about 80 wt % of a total weight of the image receiving layer;

a polymeric binder having a glass transition temperature of from −10° C. to 50° C., and present in an amount of from about 10 wt % to about 30 wt % of the total weight of the image receiving layer; and a polymeric adhesion promoter present in an amount of about 5 parts to about 30 parts per 100 parts by dry weight of the inorganic pigment filler, the polymeric adhesion promoter having a molecular weight in the range of about 10,000 Mw to about 5,000,000 Mw as measured by GPC and having a glass transition temperature at, or above, 90° C.;

wherein the polymeric adhesion promoter is formed from an aqueous emulsion having a minimum film forming temperature (MFFT) at, or not less, than 80° C., and including latex particles having a particle size from about 150 to about 350 nanometers, the latex particles having a glass transition temperature at, or above, 90° C.;

wherein the polymeric adhesion promoter has no binding power to the inorganic pigment filler, to the primary coating layer and to the raw base substrate at room temperature;

and wherein the polymeric adhesion promoter is selected from the group consisting of poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-isoprene), poly(methylstyrene-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid).

2. The recording media of claim 1 wherein:

the inorganic pigment filler is selected from the group consisting of calcium carbonate, zeolite, silica, talc, alumina, boehmite, silicates, aluminum trihydrate, titania, zirconia, calcium silicate, kaolin, calcined clay, and combinations thereof; and the polymeric binder is selected from the group consisting of a styrene butadiene copolymer, polyacrylates, polyvinylacetates, polyacrylic acids, polyesters, polyvinyl alcohol, polystyrene, polymethacrylates, polyacrylic esters, polymethacrylic esters, polyurethanes, copolymers thereof, and combinations thereof.

3. The recording media of claim 1 wherein the raw base substrate is a cellulose paper base.

4. The recording media of claim 1 wherein said media further comprises a primary coating layer on a back side of the raw base substrate.

5. The recording media of claim 1 wherein said media further comprises an adhesive layer on a back side of the raw base substrate.

6. The recording media of claim 5 wherein the adhesive layer includes a partially esterified polyvinyl alcohol (PVA) or a chemical modified starch.

7. A method of making the recording media of claim 1, the method comprising:

a. applying the primary coating layer on the image side of the raw base substrate;

b. drying the primary coating layer; and c. applying the top image receiving layer over said primary coating layer, wherein said image receiving layer comprises the inorganic pigment filler, the polymeric binder, and the polymeric adhesion promoter.

8. The method of claim 7 wherein the primary coating layer is applied on the image side and on a back side of the raw base of the media.

9. The method of claim 7 wherein an adhesive layer is applied on a back side of the raw base substrate.

10. A printing method, comprising:

jetting an ink composition containing a latex component onto the recording media of claim 1, to form a printed image with enhanced image quality and image permanence.

11. The printing method of claim 10 wherein the latex component of the ink composition has a glass transition temperature that is at, or above, 90° C.

12. The printing method of claim 10 wherein a difference of solubility parameters between the latex component of the ink composition and the polymeric adhesion promoter, of the recording media, is less than 0.8 $(\text{cal}\cdot\text{cm}^{-3})^{1/2}$.

13. The printing method of claim 10 wherein the latex component of the ink composition is identical to the polymeric adhesion promoter present in the image receiving layer of the recording media.

14. A printed article comprising the recording media of claim 1, on which a printed feature has been formed with an ink composition, wherein:

the ink composition comprises a latex component that has a glass transition temperature that is at, or above, 90° C.

15. The printed article of claim 14 wherein a difference of solubility parameters between the latex component of the ink composition and the polymeric adhesion promoter of the recording media, is less than 0.8 $(\text{cal}\cdot\text{cm}^{-3})^{1/2}$.

16. The printed article of claim 14 wherein the latex component of the ink composition is identical to the polymeric adhesion promoter present in the image receiving layer of the recording media.

* * * * *